United States Patent [19]

Kaplow

[11] 3,992,689

[45] Nov. 16, 1976

[54] PERMANENT MAGNET

[75] Inventor: Roy Kaplow, Newton, Mass.

[73] Assignee: Data Packaging Corporation, Cambridge, Mass.

[22] Filed: July 28, 1975

[21] Appl. No.: 599,631

[52] U.S. Cl. ..... 335/302; 335/304

[51] Int. Cl.[2] ..... H01F 7/02

[58] Field of Search ..... 335/302, 303, 304, 286, 335/306, 295; 206/444

[56] References Cited

UNITED STATES PATENTS 3,899,762 8/1975 Studders ..... 335/302

*Primary Examiner*—Harold Broome

*Attorney, Agent, or Firm*—Wolf, Greenfield & Sacks

[57] ABSTRACT

A magnet latch assembly for engagement with a flat plate or the like includes a permanent magnet and a surrounding ferromagnetic armature. The parts of the assembly are of an improved construction which facilitates economical assembly procedures and reduces the chances of malfunctioning in use.

10 Claims, 7 Drawing Figures

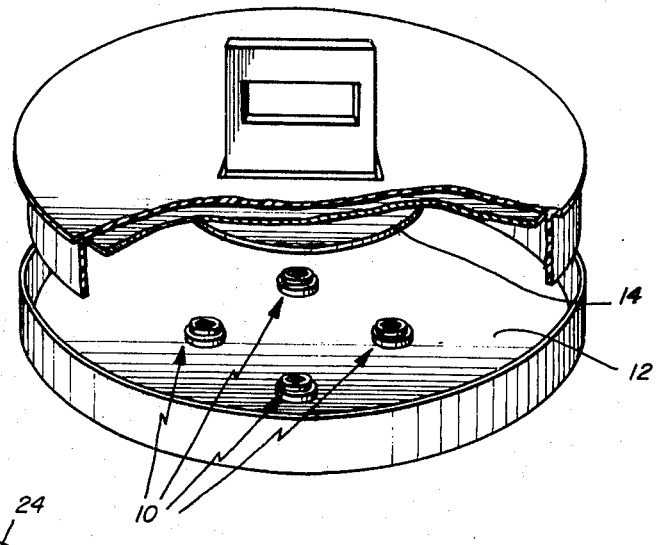
FIG. 1
FIG. 2
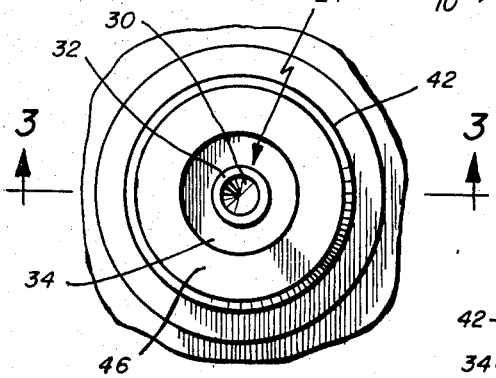
FIG. 3
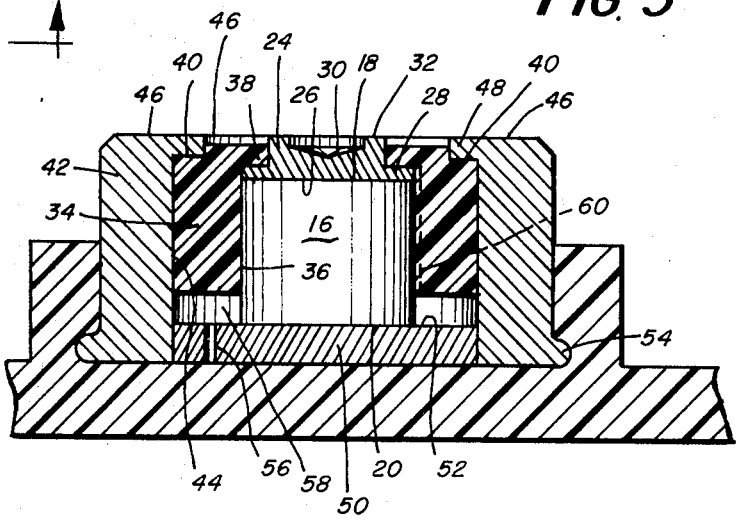
FIG. 4
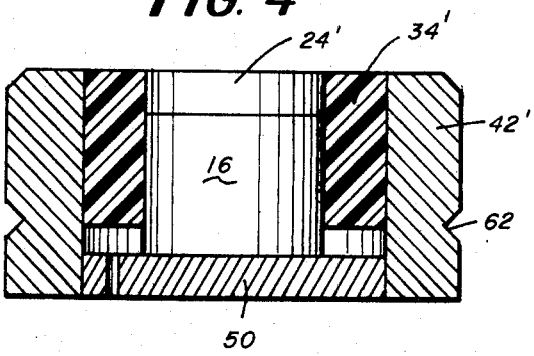
FIG. 5
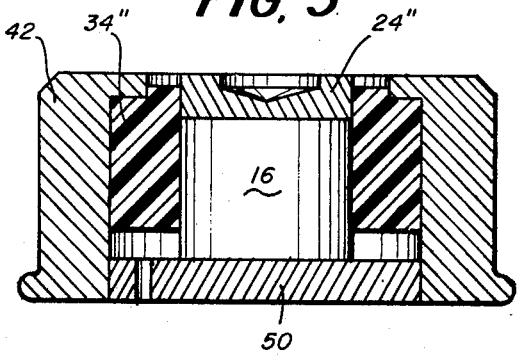

PERMANENT MAGNET

BACKGROUND OF THE INVENTION

This invention relates to a magnet assembly, for example, of the type which may be employed as a latch for use in connection with a ferromagnetic striking plate. More particularly the invention relates to magnetic locks where a high degree of reliability is an important factor, for example, when used in a computer disk package to securely lock and seal computer memory disks, tapes or the like in as near a dust free environment as possible. Also among the desirable objectives in such magnetic latches is that the magnetic latch should develop a maximum locking force with minimum size and with a relatively inexpensive permanent magnet. To this end, latches have been employed which have a permanent magnet in cooperation with a ferromagnetic, cup-like armature which receives the magnet and which cooperates to define a path for the magnetic flux to enhance the locking force which the permanent magnet can develop.

Typically, the permanent magnet is housed within an open ended ferromagnetic cup-like armature with one pole of the magnet in close, intimate and gap-free contact with the base of the armature. The armature sidewall which surrounds the magnet may be spaced from the sidewall of the magnet or in some instances may be in contact with the side of the magnet. The exposed pole of the magnet is as flat as possible under ideal conditions and the edge of the armature sidewall lies in the same plane as the face of the magnet so that the magnet and armature edge can bear against a ferromagnetic latching plate in as near flush intimate and planar contact as possible, ideally with no gaps. Even a small gap, for example, of the order of 0.001 inch, between the face of the magnet and the latch has an extremely adverse effect on the efficiency of the magnet and can reduce the effective force between the magnet and latching plate by as much as, perhaps, 25 percent. In addition it is equally important that the opposite pole of the magnet, which bears against the bottom of the armature also is in as near as complete flush abutment to avoid gaps which would also have an adverse effect on the efficiency of the magnet. Thus, the construction and manner in which the magnet is assembled is extremely critical. Prior magnet assemblies and assembly techniques have resulted in less than satisfactory results because of the inability to maintain these strict requirements. For example, typical prior assembly techniques include a final grinding of the latch plate-engaging faces of the assembled armature and magnet. Often times the permanent magnet, which is cast, has hidden voids which are exposed when grinding. This results in an unsightly pitted appearance on the face of the magnet. In addition, the exposed pits or pockets tend to collect dirt which may become lodged between the face of the magnet and the latch causing an air gap between the two which results in the loss of efficiency described above.

It also is generally desirable to plate the various parts of the magnet assembly particularly when the device is to be used in an atmosphere which may tend to corrode its parts. Typically the parts are plated before they are assembled. When the permanent magnet and armature are subsequently assembled, usually by press fitting them together, it is not uncommon for the plating to become scratched which exposes the underlying metal to the corrosive atmosphere. Because of the scratching which sometimes occurs during assembly, it is not uncommon to require that the entire device be plated again after assembly. This, of course, adds to the cost of the device. In addition, even when the assembled device is finally plated, the various etching solutions employed in the plating process may become lodged in cracks and crevices of the assembled pieces which is undesirable. In some instances, efforts are made to isolate the corrodable parts of the magnet assembly by potting it in a resinous material. This also adds to the cost of the magnet assembly.

It is among the general objects of the invention to provide a magnet assembly which avoids the foregoing difficulties.

SUMMARY OF THE INVENTION

In brief, the invention employs a cylindrical permanent magnet which is preground at its opposite ends to define flat, parallel pole surfaces. A circular magnetic face plate is placed at one end of the magnet and together they are pressed axially into and through a nonmagnetic sleeve, such as plastic or the like, with the face plate protruding slightly beyond the end of the sleeve. The subassembly of the magnet, face plate and sleeve then is pressed axially through a larger annular ferromagnetic sleeve which will form part of the armature when the assembly is completed. The outwardly facing end of the armature sleeve is ground to a flat plane before assembly with the magnet, face plate and sleeve subassembly. The parts are assembled by placing the face end of the armature sleeve against a flat registration plate and then urging the magnet subassembly through the rearward, open end of the armature sleeve toward and against the flat registration plate to bring the facing surface of the face plate and armature sleeve into the same plane. The magnet, sleeve and face plate are urged through the armature sleeve in a tight press fit by a circular end cap of a diameter to be received in the rear end of the armature sleeve in a press fit. The forcing of the end cap into the rear of the armature urges the permanent magnet, face cap and sleeve into the desired position, the face cap lying in the same plane as the face of the armature sleeve. The end cap, which is ferromagnetic, and rear end of the armature sleeve which are fitted intimately and tightly together complete and define a cup-like ferromagnetic armature. The armature end cap is pressed into the armature sleeve until the face of the magnet cap and face of the armature are in the same plane and it is not critical how far the armature end cap is pressed into the sleeve. Thus, the manufacturing tolerances may be relaxed from those which have been previously required in order to insure that the effective face of the magnet and the face of the armature lie at the same plane. All errors in tolerances are taken up by the end cap and the extent to which it advances into the open rear end of the armature sleeve. The rear end of the assembly may be encased within a plastic housing which forms part of the device to be latched.

The foregoing construction and assembly technique insures that the facing surface of the entire device will be in a single plane without requiring final grinding or plating. It also insures that during the assembly procedure there is no metal-to-metal scraping except for that between the armature end cap and the rear end of the armature which is subsequently encased in plastic, and which is therefore not exposed to the atmosphere in use.

A further aspect of the invention relates to a special configuration for the outwardly facing surface of the face cap in which the face cap has a depression in its center so that the planar surface of the face cap is relatively narrow and annular in shape. This reduces the chance of dirt or dust becoming interposed between the planar surface of the face plate and the latching plate thus reducing the chance of gaps between the magnet and the latching plate as the result of dust, dirt or other foreign matter. In addition, the special configuration of the magnet face plate tends to increase the effective latching force which can be developed.

It is among the primary objects of the invention to provide an improved magnet construction and assembly technique.

Another object of the invention is to provide a precision magnet assembly in which the manufacturing tolerances for the various parts may be relaxed.

Another object of the invention is to provide an improved magnetic latch construction including a permanent magnet and a surrounding ferromagnetic armature in which the latch engaging surfaces of the magnet and armature lie in the same plane.

A further object of the invention is to provide a magnet assembly of the type described in which the chance of gaps between the assembled parts is reduced substantially.

A further object of the invention is to provide a magnetic latch in which the chance of gaps resulting from dirt or other foreign matter between the magnet face and the latch plate is reduced.

A further object of the invention is to provide a magnet consturction which insures the presentation of a smooth unpitted latch-engaging face.

A further object of the invention is to provide a magnet construction including a permanent magnet and an armature in which the number of necessary surface grinding procedures are reduced.

A further object of the invention is to provide an improved magnet construction of the type described in which there is no requirement to grind any of the surfaces after the parts of the assembly have been assembled.

Another object of the invention is to provide a magnetic assembly of the type described in which the parts may be preplated and in which the plating is not destroyed during the assembly procedure.

Still another object of the invention is to provide an improved magnet construction of the type described which develops improved latching force for a relatively small sized permanent magnet and which enables the overall size of the magnet assembly to be reduced.

DESCRIPTION OF THE DRAWINGS

The foregoing and other objects and advantages of the invention will be understood more fully from the following further description thereof, with reference to the accompanying drawings wherein:

FIG. 1 is an illustration of the manner in which magnet assemblies of the type described may be employed to latch sections of a computer disk or reel case together;

FIG. 2 is a plan view of the face of an assembled magnet assembly;

FIG. 3 is a section of the assembly shown in FIG. 2 as seen along line 3—3 of FIG. 2;

FIG. 4 is an illustration of a modified embodiment of the invention;

FIG. 5 is an illustration of a further modified embodiment of the invention;

DESCRIPTION OF THE PREFERRED EMBODIMENT

Figure 6:
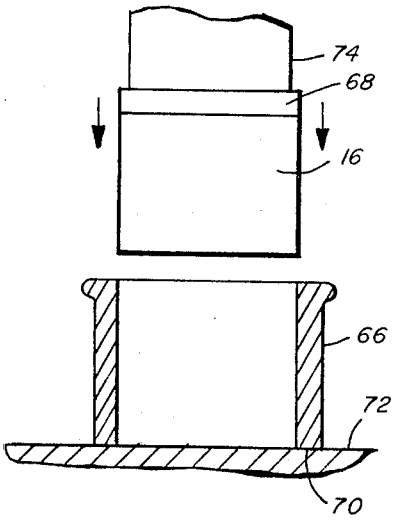
FIG. 6 is an illustration of a simplified embodiment of the invention further illustrating the improved method of assembly employed in the invention.

FIG. 1 illustrates but one environment in which magnetic latches of the type described may be employed. Here, a plurality of magnet assemblies 10 are mounted to one of the halves 12 of a computer disk storage pack. The other half of the storage pack includes a flat ferromagnetic latching plate 14 which cooperates with the face of each magnetic assembly to lock the two halves of the storage pack together. As mentioned above, in order to achieve the full and most efficient latching force the latching plate must be brought into full, firm and complete intimate contact with the operative faces of the magnet assembly.

FIGS. 2 and 3 show the elements of the magnet assembly which include a permanent magnet 16 such as alnico. The magnet 16 is cylindrical and its opposite ends are ground flat and smooth before assembly. It is important that the ends are ground so that the pole faces 18, 20 of the magnet are parallel to each other. It may be noted that the cylindrical side of the magnet need not be ground with the precision required in prior such devices.

Instead of employing the pole face 18 of the magnet to contact the latch plate 14 directly as has been the case with the prior art devices, the preferred embodiment of the invention may include a ferromagnetic pole piece or face cap 24 which has a flat planar bottom surface 26 and which bears in flush, planar and intimate contact with the pole face 18 of the permanent magnet. The pole cap 24 has a cylindrical collar 28 which is the same diameter as that of the magnet 16. The inner portion of the face cap 24 also is circular and protrudes away from the magnet 16. In this embodiment of the invention, the other end of the face cap 24 may have a conical depression 30 which defines an annular surface 32 at the outermost extremity of the face cap. The annular surface 32 lies in a plane so that it may contact the planar latching plate 14 fully and in flush intimate contact. By employing the magnet cap 24 to engage the plate 14, instead of the pole face 18 of the magnet, the difficulties previously described with regard to surface irregularities of the pole face 18 are completely avoided.

The magnet 16 and pole cap 24 are retained within the non-magnetic (slightly diamagnetic or paramagnetic) sleeve 34 which may be made, for example, from plastic. Sleeve 34 is circular and has an inside bore 36 dimensioned to receive the magnet 16 and face cap 24 in a snug fit. The outer end of the sleeve 34 has an inwardly extending circular flange 38 of smaller diameter than the bore 36 which receives the protruding portion of the pole cap 24 in a tight fit. The thickness of the flange 38 is such that when the parts are assembled as shown in FIG. 3, a portion of the face cap 24 will extend beyond the outer end of the flange 38 so that the plane defined by the annular surface 32 will be disposed outside of the sleeve 34. The sleeve 34 also includes a shoulder 40 formed about its outer end which engages the armature sleeve 42 as will be described. The length of the sleeve 34 is such that when the parts are assembled, there will be no interference to the assembly procedure as will be described.

The armature includes a cylindrical armature sleeve 42 which is made from ferromagnetic material. The armature sleeve 42 defines an inner bore 44 of a diameter to receive the outside diameter of the sleeve 34 in a tight, snug fit. The outer end of the armature sleeve 42 is ground before assembly to define an annular, flat, planar surface 46 which is intended to lie in the same plane with the annular surface 32 when the parts are assembled. The surface 32 of the face cap 24 and surface 46 of the armature sleeve will bear in flush intimate contact with the latching plate at the same time and without any gaps which might adversely affect the latching force developed.

The facing end 46 of the armature sleeve 42 also includes an inwardly extending flange 48 which, when the parts are assembled, is received within the shoulder 40 formed at the outer end of the non-magnetic sleeve 34. Engagement of the shoulder 40 with the flange 48 limits the extent to which the sleeve 34 may be urged into the armature sleeve 42. The parts are dimensioned so that when assembled, the annular face 46 of the armature sleeve 42 will be disposed beyond the outermost end of the insulative sleeve 34.

The device is assembled by placing the surface 46 of the armature sleeve 42 against a flat registration plate. The insulative sleeve 34 then is inserted through the open rear end of the bore 44 of the armature sleeve 42 until the shoulder 40 engages the flange 48. The face cap 24 and permanent magnet 16 then are urged together through the bore 36 of the insulative sleeve 34 until the flat annular surface 32 of the face cap 24 is in flush and firm engagement with the plane of the registration plate thus insuring that surface 32 and surface 46 will lie in precisely the same plane. The magnet 16 and face cap 24 are advanced through the insulative sleeve 44 by an armature end cap 50 which is made from a ferromagnetic material and which has at least its forwardly facing surface 52 formed to define a flat plane. The armature end cap 50 has an outside diameter which is received in a tight press fit within the bore 44 of the armature sleeve 42, so that after the armature end cap 50 has been urged into the bore 44 as far as it will go, it then remains in firm, full and continuous contact with the armature sleeve 42, thus completing the cup-like armature configuration. The surface 52 of the end cap 50 is in full, intimate and continuous contact with the inner pole face 20 of the permanent magnet 16. It should be noted that it is not critical whether the armature end cap 50 extends slightly out of the bore 44 or whether its rear surface is recessed somewhat within the bore as this has no significant effect on the magnetic characteristics of the assembly. Because of the magnet 16 and face cap 24 will always be urged until they have reached a position in which the annular surface 32 of the face cap 24 lies in precisely the same plane as the surface 46 of the armature sleeve 42, the axial dimensions of the various parts are not critical and the tolerances in their manufacture may be relaxed which helps to reduce the cost of the assembly.

The various parts such as the armature sleeve 42, face cap 24 and armature end cap 50 all may be preplated before assembly. As mentioned above, it is one of the advantages of the invention that none of the finally exposed plated surfaces will have been scratched during the press-fitting assembly procedure. In this regard the non-magnetic sleeve 34 is made from plastic and will not scratch the surfaces of the face cap 24 or the armature sleeve 42. While there is metal-to-metal sliding contact between the armature end cap 50 and the bore 44 at the rear end of the armature sleeve, these regions of the assembly will be embedded in the plastic base from which the device to be latched is made. Thus, even though there may be some scratching of the plating at the more inner regions between the end cap 50 and the armature sleeve 42, these scratched regions will be isolated from the atmosphere. In this regard, it may be desirable to form an annular projection 54 at the inner end of the periphery of the armature sleeve 42 to lock the assembly firmly within the plastic case material. If desired, a small hole 56 may be formed through the armature end cap 50 to enable any air which may have been trapped in the annular region 58 to escape. This insures that there will be no pressure built up within the annular space 58. Also it may be desirable to provide the narrow groove, suggested in phantom at 60, along the inner bore 36 of the sleeve 34 to enable air to escape from the annular region defined between the face cap 24 and the flange 38 of the sleeve 34.

The conical depression 30 in the face cap 24 serves to reduce the facing area which will engage the latching plate 14 to that which is defined by the annular flat surface 32. The reduced area defined by the annular flat surface 32 minimizes the chance of dirt or foreign matter becoming lodged between the abutting surfaces of the face cap 24 and the latching plate 14. In addition, it is believed that the foregoing construction of the face cap 24 tends to reduce leakage of the magnetic flux when the latching plate 14 is not engaged. It is also believed to guide the magnetic flux in a more efficient manner when in contact with the latch plate to further minimize leakage which results in an increased latching force.

The insulative sleeve 34 also may be of a split ring character instead of the substantially cylindrical continuous structure described. This may be desirable when the device is used in an environment where the temperature may vary somewhat and where the various parts of the device have different shrinkage rates. The material from which the split sleeve 34 may be made may be selected from a variety of non-magnetic materials having the desired coefficient of expansion in relation to the other ferromagnetic materials used in the device. For example, materials such as nylon, polyethylene or the like may be selected.

FIG. 4 shows, for example, some of the modifications which may be made to the invention. For example, the armature sleeve 42′ in this embodiment is substantially cylindrical and is free of any flanges. Instead, an annular groove 62 may be formed about the lower portion of the armature sleeve 42 to interlock with the molded plastic piece in which the magnet assembly will be embedded. The insulative sleeve 34′ may be substantially cylindrical without flanges, shoulders or the like. The face cap 24′ is a substantially cylindrical slug. The various parts are dimensioned so that they may be press fitted together in the same manner as described with the previous embodiment, the press fit being sufficient to hold the parts together. The advantages of minimal grinding and minimal scratching of the plated surfaces are achieved in this embodiment. While this embodiment does not include the preferred configuration of the face cap 24 it is of simpler construction than the previously described embodiment and can be employed to fabricate a magnet assembly at somewhat less cost because of the simplified configuration of its parts.

FIG. 5 illustrates an embodiment of the invention which is of intermediate complexity in that there is no shoulder-flange beween the insulative sleeve 34'' and the face cap 24'' which results in reduced cost and fabrication of these parts.

Figure 7:
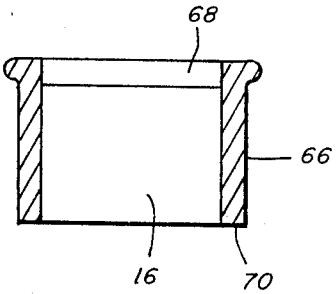
FIG. 7 is an illustration of the magnet assembled in accordance with the method suggested in FIG. 6.

While the preferred embodiments of the invention have been described thus far primarily in connection with a magnet assembly having a face cap 24 and intermediate insulative sleeve, the improved method of assembly also may be employed in connection with more simplified magnet constructions. For example, FIGS. 6 and 7 show a magnet assembly which includes a permanent magnet 16, a surrounding armature 66 and a rear end cap 68, without the face cap 24 or insulative sleeve 34. The omission of the insulative sleeve and face cap will, of course, result in a magnet assembly does not have all of the desirable features discussed above. In those less critical environments where a somewhat lesser quality magnet can be tolerated and where minimal cost is a primary consideration, the assembly method of the invention still is highly desirable. Thus, the simplified type of magnet as shown in FIG. 6 may consist of a ferromagnetic armature 66 and permanent magnet 16 dimensioned to be press fitted into the armature 66. The magnet 16 is preground at its opposite forward and rearward pole faces as described in connection with the previous embodiment and, similarly, the forwardly facing end 70 of the armature similarly is ground. The assembly technique includes placing the armature 66, face end down on a flat registration plate 72 and then urging the magnet 16 into and through the armature 66 until the forward face of the magnet abuts the registration plate 72, thus insuring planar alignment of the forward surfaces of the armature and permanent magnet. As with the previously described embodiments, the permanent magnet is urged, by a drive member 74 through the armature sleeve 66 toward the registration plate 72 by the rear end cap 68 which is dimensioned to be snugly press fitted into the rear end of the armature 66 to establish firm, initimate contact with the rear pole surface of the magnet as well as with the armature. Even with this simplified arrangement, many of the previously described advantages are achieved such as, for example, the omission of the requirement to finally grind the magnet after assembly and the avoidance of exposed scratches in the finish of the parts which avoids the necessity for final plating after assembly.

It should be understood that the foregoing description of the invention is intended merely to be illustrative thereof and that other modifications and embodiments may be apparent to those skilled in the art without departing from its spirit.

Having thus described the invention, what I desire to claim and secure by Letters Patent is:

1. A magnet assembly comprising:

a permanent magnet having opposite forward and rearward pole faces;

a pole piece having a flat surface in continuous, intimate abutting contact with the forwardly facing pole face of the permanent magnet;

a non-ferromagnetic sleeve surrounding the abutting permanent magnet and pole piece;

a ferromagnetic sleeve surrounding the non-ferromagnetic sleeve, each of the ferromagnetic sleeve and the pole piece defining a flat forward face which lie in the same plane; and a ferromagnetic plug closing the inner end of the ferromagnetic sleeve and being in firm and substantially continuous electrical contact therewith, the plug having interior, forwardly facing surface in flat, substantially continuous contact with the opposite rearward pole face of the permanent magnet.

2. A magnet assembly as defined in claim 1 further comprising:

the forwardly facing surface of the pole piece having a central depression formed therein, the remaining forward flat surface of the pole piece being annular in configuration.

3. A magnet assembly as defined in claim 2 wherein the central depression is generally of inverted conical configuration.

4. A magnet assembly as defined in claim 1 further comprising:

the axial length of the non-ferromagnetic sleeve being less than the total combined length of the pole piece and magnet.

5. A magnet assembly as defined in claim 1 further comprising:

the pole piece having, at its rearward end, a flange equal in diameter to that of the permanent magnet, the flange defining a shoulder, the forward end of the non-ferromagnetic sleeve having an inwardly extending collar at its forwardly facing end which overlies the shoulder of the pole piece;

the forwardly facing end of the non-ferromagnetic sleeve having a shoulder formed thereon; and the forwardly facing end of the ferromagnetic sleeve having an inwardly extending collar which engages the shoulder on the non-ferromagnetic sleeve.

6. A magnet assembly as defined in claim 1 further comprising:

the forwardly facing surface of the non-ferromagnetic sleeve lying in a plane which is disposed rearwardly of the plane in which the forwardly facing surfaces of the pole piece and ferromagnetic sleeve are disposed.

7. A magnet assembly as defined in claim 1 further comprising:

at least a portion of the outer surface of the ferromagnetic sleeve being shaped to interlock with a base member in which the magnet assembly may be received.

8. A magnet assembly as defined in claim 1 further comprising:

vent passage means formed in at least some of the elements of the magnet assembly to enable air within the void regions of the magnet assembly to be vented to the atmosphere during assembly.

9. A method for assembling an armature magnet comprising:

providing a permanent magnet having flat parallel opposite pole surfaces;

placing a flat surface of a ferromagnetic pole piece in intimate flush contact with one pole surface of the permanent magnet;

surrounding the combined magnet and pole piece with a non-ferromagnetic sleeve;

providing a ferromagnetic sleeve having a bore dimensioned to receive the non-ferromagnetic sleeve, the ferromagnetic sleeve having a flat end surface which substantially defines a plane;

locating the subassembly of the permanent magnet, pole piece, and non-ferromagnetic sleeve within the bore;

locating a flat registration plate against the front end of the assembly;

urging the permanent magnet forwardly until the pole piece and end surface of the ferromagnetic sleeve are in firm flush contact with the registration plate, thereby locating the forwardly facing surfaces of the pole piece and ferromagnetic sleeve in the same plane; and placing a ferromagnetic end cap into the opposite end of the ferromagnetic sleeve in firm and continuous contact therewith and in firm and flat contact with the inner pole surface of the permanent magnet.

10. A method as defined in claim 9 wherein said step of urging the magnet toward the registration plate comprises:

locating the ferromagnetic end cap in contact with the inner pole of the magnet and in alignment with the bore at the rear end of the ferromagnetic sleeve; and urging the end cap simultaneously into the bore and thereby urging the magnet forwardly.

* * * * *